United States Patent [19]

Kirby

[11] Patent Number: 4,945,639

[45] Date of Patent: Aug. 7, 1990

[54] BULLET KNIFE WITH SHELL SHEATH/HANDLE

[76] Inventor: Randall R. Kirby, 3912 Markle Ave., Terre Haute, Ind. 47805

[21] Appl. No.: 410,875

[22] Filed: Sep. 22, 1989

[51] Int. Cl.[5] ..... B26B 1/00

[52] U.S. Cl. ..... 30/329; 30/340; 30/342; 30/151

[58] Field of Search ..... 30/329, 340, 151, 342, 30/337

[56] References Cited

U.S. PATENT DOCUMENTS 3,977,077 8/1976 Rebold ..... 30/151

*Primary Examiner*—Douglas D. Watts
*Assistant Examiner*—Willmon Fridie, Jr.
*Attorney, Agent, or Firm*—H. John Barnett

[57] ABSTRACT

A two part, ornamental pocket knife having the appearance of a rifle bullet when sheathed. The shell portion of the bullet serves both as a sheath and a handle for the knife blade, which is rigidly anchored in the inner end of the bullet tip.

2 Claims, 1 Drawing Sheet

BULLET KNIFE WITH SHELL SHEATH/HANDLE

BACKGROUND

1. Field of the Invention

This invention relates to an ornamental pocket knife having the appearance of a rifle bullet when sheathed. It is a two part construction in which the shell portion of the bullet serves both as a sheath and as a handle for the exposed blade.

2. Description of Related Art

There are a number of patents relating to various types of pocket knives. U.S. Pat. No. 1,268,930 describes a manicuring implement having a central body from which a knife blade and a nail cleaner extend in opposite directions. Both can be covered by tubular casings threaded onto the central body. Each tubular casing serves as a handle for the oppositely disposed tool, but each tool requires a separate sheath, so at least one sheath is separated from the implement when in use. U.S. Pat. No. 1,176,583 describes a knife used by linemen which has a double threaded nipple disposed between the blade and the integral steel handle. A single insulating sleeve is provided which covers the blade or the steel handle. One or the other is exposed at all times.

U.S. Pat. No. 3,760,438 describes a combination knife and fishing tackle assembly. U.S. Pat. No. 4,062,118 has a knife handle adapted to receive and hold interchangeable blades. Other related patents include U.S. Pat. Nos. 4,400,878, 4,404,747, 4,481,712, 4,805,818, 4,811,486 and 4,815,211. None of the above patents show a bullet knife having a shell body which is both a sheath and handle for the knife, and which has the appearance of a rifle bullet when sheathed.

SUMMARY OF THE INVENTION

This invention is directed to an ornamental pocket knife which has the appearance of a rifle bullet when the blade is sheathed. Most embodiments of the bullet knife are small enough to be safely carried in a pocket when sheathed, because the blade is completely enclosed by the shell and the knife tang is enclosed by, and anchored in, the lead tip of the bullet. A blade of suitable size to fit inside a brass rifle shell is anchored in the inner end of a rifle bullet tip. The tang of the blade is first enclosed in a brass sleeve and is then fitted into a close fitting hole drilled in the inner base of a lead bullet tip. The bullet tip and sleeved tang are then heated to melt the lead around the tang to fill the sleeve and to bond the sleeved tang to the lead bullet tip. The blade/-bullet tip combination is then immersed in water to quench the lead, making it harder and to give better adherence to the sleeved tang of the knife blade.

Figure 1:
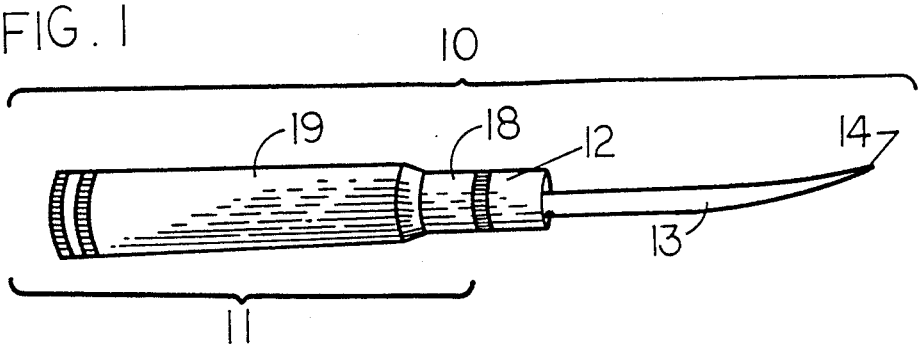
FIG. 1 of the drawings is a side view of the assembled bullet knife ready for use.
Figure 2:
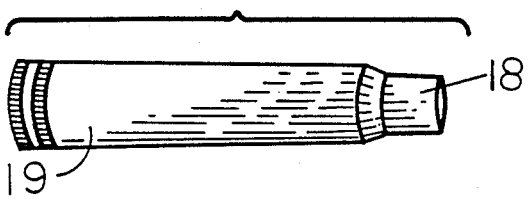
FIG. 2 is a side view of the separated parts of the bullet knife with some parts broken away to show the sleeved tang imbedded in the inner end of the bullet tip.
Figure 2:
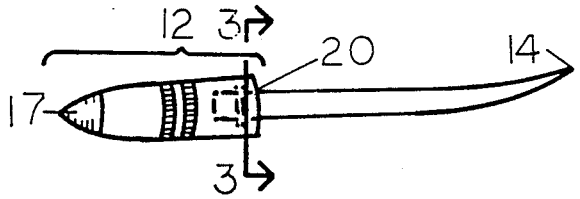
Figure 3:
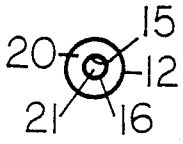
FIG. 3 is a enlarged transverse sectional view taken on line 3—3 of FIG. 2 showing the sleeved tang imbedded in the rifle bullet tip.
Figure 4:
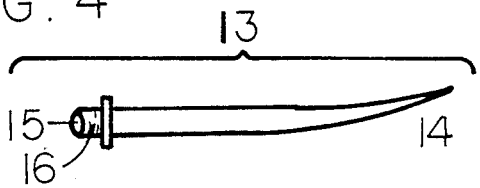
FIG. 4 is a side view of the knife blade showing the cylindrical sleeve disposed on the tang before imbedding the tang in the inner end of the rifle bullet tip.
Figure 5:
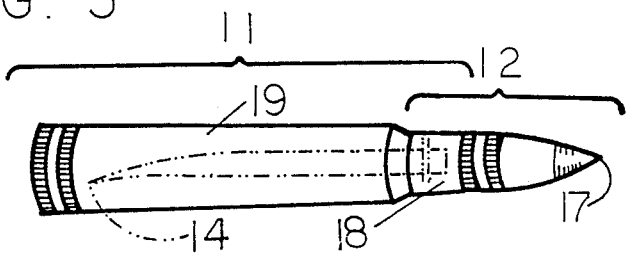
FIG. 5 is a side view of the bullet knife in the closed position with part of the shell broken-away to show the sheathed blade.

As shown in the drawings, assembled bullet knife 10 includes a shell sheath/handle 11, a rifle bullet tip 12 and a knife blade 13. The knife blade 13 includes a blade end 14 and an integral tang 15, over which a sleeve 16 is snugly fitted, as best seen in FIGS. 3 and 4.

When the knife 10 is assembled in the open position, the outer end 17 of the bullet tip 12 fits snugly in outer end 18 of shell sheath/handle 11, which is more constricted than main body 19 of shell sheath/handle 11.

When the knife 10 is assembled in the closed position, the inner end 20 of the bullet tip 12 fits snugly in the outer end 18 of the shell sheath/handle 11, and the blade end 14 is completely enclosed in, and protected by, the shell sheath/handle 11.

In the presently preferred embodiment of the invention, the bullet knife 10 is made from a .375 caliber H & H Magnum rifle bullet which contains no powder or primer. The bullet casings and lead bullet tips may be purchased as separate items from a sporting goods outlet, or rifle bullets may be disassembled for such purpose, taking care to carefully remove the powder charge before removing or detonating the primer.

A $\frac{3}{8}$ inch diameter opening 20 is drilled in inner end 21 of bullet tip 12 to a depth of about $\frac{1}{2}$ inch. The tang 15 is then fitted with a $\frac{3}{8}$ inch diameter cylindrical steel sleeve 16 which snugly fits over the tang 15. The sleeved tang 15 is then inserted into the opening 20 so that only the blade end 14 is exposed outside the inner end 21 of the bullet tip 12. The bullet tip 12 with the knife blade 13 assembled in it is then heated to melt the lead of the bullet tip 12 surrounding the sleeved tang 15 to completely fill the sleeve 16 and any voids between the sleeve and bullet tip 12.

The heated bullet tip 12 is then cooled rapidly by dropping it in water to temper the lead to make it harder than before so that it adheres better to the tang 15. After the bullet tip 12 has cooled, the knife blade 13 can be sheathed in the shell sheath/handle 11, or fit in place with blade 13 exposed and ready for use.

It is also contemplated that larger sized bullet knives could be made from larger caliber rifle shells and bullet tips. For example a 50 caliber shell and bullet tip could be employed in the same manner as described above using proportionately larger blades and sleeves. For larger shells, the bullet tip may be sufficiently large to serve as a knife handle.

Tapered shell casings are presently preferred because they have a more elongated bullet tip which provides a longer and stronger mounting and support for the tang of the knife blade. Such tapered casings also provide a better fit and stronger support for the bullet tip when the blade is exposed for use.

What is claimed is:

1. A bullet knife of two part construction comprising:

a brass rifle shell having an outer, tapered open end adapted to receive a bullet tip, said rifle shell serving both as a sheath and a handle for said knife;

a lead bullet tip having a flat inner end and an outer, nose-shaped end, said bullet tip being adapted to fit snugly in the outer, tapered open end of said brass rifle shell; and a knife blade rigidly secured to, and extending axially from the flat, inner end of said bullet tip, said bullet tip, said bullet tip being adapted to be disposed in the outer, tapered open end of said rifle shell in a first and second position, said first position having the knife blade exposed so that the rifle shell defines a knife handle, and said second position having the knife blade enclosed inside the rifle shell so that the rifle shell defines a sheath.

2. A bullet knife according to claim 1, in which the knife blade has an integral tang; and an elongated sleeve surrounded the tang, said tang and surrounding sleeve being imbedded in the lead bullet tip at the flat, inner end thereof to provide a firm anchor means for said knife blade.

* * * * *